United States Patent [19]

Kirkpatrick

[11] 4,378,737

[45] Apr. 5, 1983

[54] ROLLER APPARATUS WITH REPLACEMENT BLANKET

[75] Inventor: Alan D. Kirkpatrick, Martinsville, N.J.

[73] Assignee: Robud Company, Pine Brook, N.J.

[21] Appl. No.: 268,871

[22] Filed: Jun. 1, 1981

[51] Int. Cl.[3] ..... B41F 27/06

[52] U.S. Cl. ..... 101/415.1

[58] Field of Search ..... 101/415, 415.1, 378, 101/401

[56] References Cited

FOREIGN PATENT DOCUMENTS

| | | | |
|---|---|---|---|
| 2545618 | 4/1977 | Fed. Rep. of Germany | 101/415.1 |
| 1003292 | 3/1952 | France | 101/415.1 |
| 368609 | 3/1932 | United Kingdom | 101/415.1 |
| 600037 | 8/1945 | United Kingdom | 101/415.1 |
| 666356 | 2/1952 | United Kingdom | 101/415.1 |
| 1234158 | 6/1971 | United Kingdom | 101/415.1 |

*Primary Examiner*—E. H. Eickholt

*Attorney, Agent, or Firm*—Carella, Byrne, Bain & Gilfillan

[57] ABSTRACT

The invention relates to a roller having a core with a channel formed in the surface which extends across the surface of the core. The channel is tapered in width from a first width adjacent a first edge to a second width adjacent a second opposite edge. A blanket is provided for covering the core with the blanket having a split element adapted to fit around the surface of the core and having first and second abutting edges. The blanket has first and second flanges depending from its abutting edges which flanges, when in abutting relationship, define a cross-sectional area substantially identical to the core channel.

9 Claims, 12 Drawing Figures

ROLLER APPARATUS WITH REPLACEMENT BLANKET

BACKGROUND OF THE INVENTION

1. Field of the Invention

This invention is directed to roller apparatus. More specifically, this invention is directed to roller apparatus which utilize a core roll and a removeable blanket mounted thereon. Typical applications for such roller apparatus include tensioning rollers as are utilized in the textile industry, backing rollers such as are utilized in the printing industry and anvil type rollers which are utilized in the die cutting industry. These, of course, are only typical applications and many other such applications will be immediately recognized by those having skills in these arts.

2. Description of the Prior Art

It has been long recognized in the machine design industry that a roller apparatus including a basic structural core and a replaceable blanket cover are highly desirable because of the economics involved. Clearly it is more desirable to replace a cover on a roll type device rather than to replace the entire device. This recognition has been reflected in the state of the art and such replaceable blankets are disclosed in U.S. Pat. Nos. 4,073,208 and 4,073,207 as well as in the patent cited in their prosecution.

The split type blankets which have been developed for and utilized primarily in the die cutting industry are beneficial because they permit mounting of the blanket on a core without the necessity for disassembling the machine with respect to which the roller is being utilized.

As experience in the art has developed, however, certain problems have been identified. Among these is that many of the structures for locking the blankets in place on the cores are complex and expensive. Additionally, installation of the blankets often requires access to the entire transverse surface of the core which, in many applications, is not possible. Still further, the amount of time required to effect a blanket replacement, while improved over what was previously accepted in the prior art, still is subject to further improvement.

It should also be noted that in many fields, particularly the textile and related industries, general acceptance of replaceable blankets for rollers has not been achieved. One reason for this is the fact that many rollers in this industry are non-cylindrical in shape thus rendering the problem of locking the blanket with respect to the roller to be significant. Heretofore many such non-cylindrical rollers e.g., frustoconical rollers, have been traditionally structured, i.e., the cover material has been placed on the core by casting or vulcanizing and thereafter the surface machined to be true. This process, of course, is extremely expensive and the expense is compounded when the surface of the roller is subjected to wear such as to require replacement. In such circumstance the entire roller apparatus must be removed from the machine and replaced with a different roller. Thus the machine owner is required to maintain an inventory of fresh rollers so that the apparatus will not be inoperable during roller replacement. Further, actual removal of the rollers and installation of the new rollers requires down time sufficient to disassemble the structure and thereafter reassemble with the new roller in position. Clearly, the foregoing constitutes an uneconomical approach to the problem.

SUMMARY OF THE INVENTION

It is an object of the present invention, therefore, to provide a roller assembly including core and replaceable blanket cover wherein the blanket cover may be replaced without disassembling the core from the machinery being served.

Another object of the present invention is to provide a replaceable blanket for use with irregular as well as regular shaped cores e.g., frustoconical cores as well as cylindrical cores.

Yet an additional object of the present invention is to provide a roller apparatus including core and blanket wherein it is not necessary to maintain an inventory of core structures to accommodate replacement of blankets.

An additional object of the present invention is to provide a roller apparatus having a replaceable blanket wherein rigid securing of the blanket with respect to the core is achieved by passing an irregularly shaped locking flange into a correspondingly irregularly shaped channel formed in said core through transverse insertion of said locking flange into said core.

These objects and others not enumerated are achieved by the roller apparatus according to the invention one embodiment of which may include a core, means formed on the core for mounting the core with respect to a machine to be served, a channel formed in the surface of the core extending across said surface, the channel being tapered in width from a first width adjacent a first edge to a second width adjacent a second opposite edge, a blanket for covering the core, the blanket comprising a split element adapted to fit around the surface of the core and first and second flanges depending from first and second edges of the blanket, the edges of the blanket and the flanges cooperating to define abutting edge surfaces which, when in abutting engagement, permit the first and second flanges to define a locking element having a cross-sectional area substantially identical to the channel formed in the surface of the core.

BRIEF DESCRIPTION OF THE DRAWINGS

A more complete understanding of the present invention may be had from the following detailed description, particularly when read in the light of the accompanying drawings, wherein.

DETAILED DESCRIPTION

As noted above this invention is directed to rollers, and in particular to rollers of the type including cores and elastomeric coverings.

Figure 1:
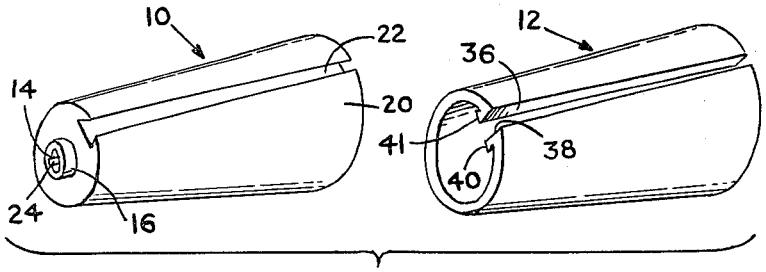
FIG. 1 is a prospective view of a core and replaceable blanket structure in accordance with the present invention.

Referring therefore to FIG. 1 there is shown a core structured according to the present invention and designated generally by the reference numeral 10 and a blanket for covering core 10, which blanket is designated generally by the reference numeral 12.

Core 10 is a structural member manufactured from materials such as bronze, aluminum, cast iron, lexan, nylon, high density polyethylene and the like. The core 10 is generally frustoconical having an axially extending core 14 extending therethrough. The ends of core 10 are provided with hubs 16 which are adapted to be attached to shafts (not shown) for rotation therewith.

Figure 2:
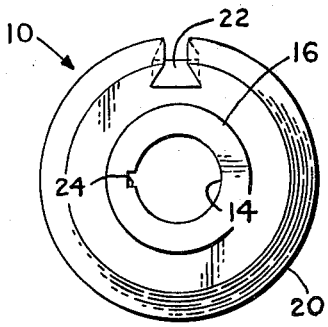
FIG. 2 is an end view of the core structure of FIG. 1.

The frustoconical surface 20 of core 10 is provided with a channel 22 extending transversely across the entire width of the core surface. As best may be seen in FIG. 2, core 14 is provided with an axially extending hey slot 24 extending therethrough. Additionally it can be seen that channel 22 is generally dove-tailed in cross-sectional configuration. Channel 22 is substantially constant in depth and tapers from a relatively large width adjacent the small diameter end of core 10 to a relatively small width adjacent the large diameter end of core 10.

Figure 3:
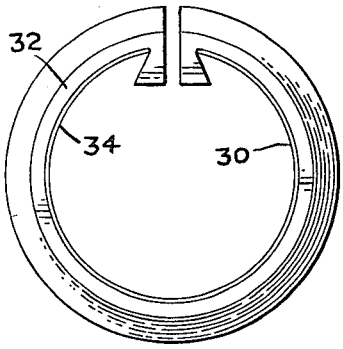
FIG. 3 is an end view of the blanket structure shown in FIG. 1.

Referring now to FIG. 3 there is shown an end view of a blanket 12 which is structured in accordance with the present invention. Blanket 12 includes a base sheet 30 and a cover 32. Base sheet 30 may be manufactured of any of many materials recognized to be suitable for this use, e.g. sheet steel, aluminum or the like. The cover 32 may be manufactured of materials such as polyurethane, rubber or other suitable elastomerically deformable material.

Base sheet 30 is a split-ring member the inner surface 34 of which corresponds in configuration to the outer surface of core 10 when the blanket 12 is assembled with core 10 to define a roller structure. Bonded to the outer surface of base sheet 30 is cover 32. Cover 32 may be of polyurethane, rubber or other suitable elastomerically deformable material. In this regard, cover 32 may be manufactured by binding the cover material to base sheet 30 incidental to molding the cover material to provide the desired configuration of the outer surface of the cover. Satisfactory cover configurations may be achieved through precision molding. However, to the extent that very close tolerances may be desired, the cover surface may be machined subsequent to the molding process.

Figure 4:
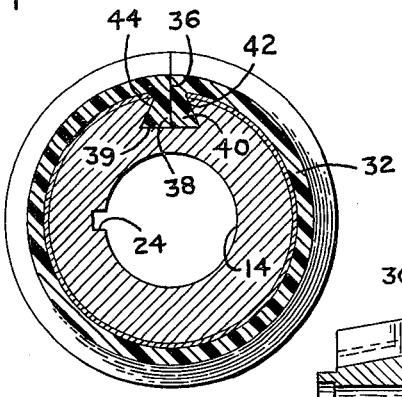
FIG. 4 is a cross-sectional elevational view showing the core and blanket of FIG. 1 in assembled position.
Figure 5:
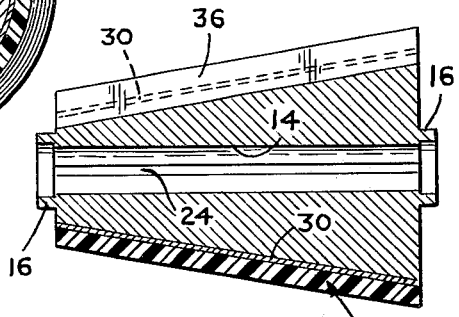
FIG. 5 is a transverse cross-sectional elevational view of the core and blanket of FIG. 1 in assembled position.

As best may be seen in FIG. 4, base sheet 30 is sized to define something less than a closed ring when blanket 12 is assembled to core 10. More specifically, when blanket 12 as assembled to core 10 such that first edge 36 of cover 32 abuts second edge 38 of cover 32, the edges of base sheet 30 are spaced to define a gap 39. The width of gap 39 varies across the width of blanket 12 such as to correspond to the variation in width of tapered channel 22 in core 10.

Depending from the bottom surface of cover 32 along its first and second edges 38 and 39 are first and second flanges 40 and 41, respectively. The outer edge of first flange 40 cooperates with an edge of cover 32 to define first cover edge 36. It should be recognized, however, that in the embodiments shown, flanges 40 and 41 are integral with the material of cover 32. The transversely extending edges 42, 44 are tapered and the depth of flanges 40 and 41 is generally equal to the depth of channel 22 in core 10 such that when blanket 12 is assembled to core 10 the flanges 40 and 41 cooperate to define a dove-tail insert which corresponds in shape to channel 22 in core 10 and which has a tight surface-to-surface fit therewith.

Considering now the significance of the structure of blanket 12 in conjunction with the structure of core 10, it can now be recognized that assembly of blanket 12 to core 10 may be achieved by inserting the narrow ends of flanges 40 and 41 within the wide end of channel 22 and sliding blanket 12 onto core 10. Because of the disparity in the combined width of flanges 40 and 41 as compared with channel 22, there is little or no resistence experienced between flanges 40 and 41 and channel 22 until blanket 12 is substantially totally covering core 10. At such a point the surfaces 42 and 44 of flanges 40 and 41 engage the surfaces of channel 22 and establish a surface-to-surface friction fit. The friction fit established between flanges 40 and 41 and channel 22 is such as to draw edges 36 and 38 into tight abutting relationship and to establish a uniform surface of blanket 12 around core 10. Further the friction fit also locks blanket 12 securely on core 10 without the need for additional locking means.

If blanket 12 becomes worn or it becomes desirable to replace blanket 12 with a blanket of a different material to accommodate some operating condition, the operator may use a rubber mallet or similar tool to strike the blanket at the narrow end of the locking means defined by flanges 40 and 41 such as to overcome the surface friction between the flange surfaces and the surface of channel 22. With the friction overcome the blanket may be displaced transversely across the core and removed once clear of the core. In this regard it should be noted that removal of the blanket does not require disassembly of the core on the shafts on which it may be mounted because the blanket is split and is sufficiently deformable to be passed over a shaft or the like.

Figure 6:
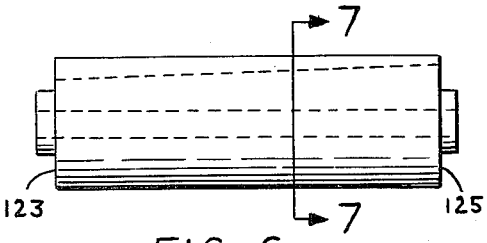
FIG. 6 is a transverse view of another embodiment of roller apparatus structured in accordance with the present invention.
Figure 7:
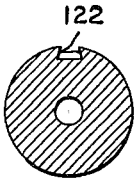
FIG. 7 is a cross-sectional elevational view to the plane 7—7 of FIG. 6.
Figure 8:
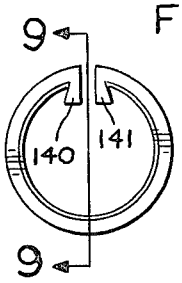
FIG. 8 is an end view of the blanket utilized in the embodiment of FIG. 6.
Figure 9:
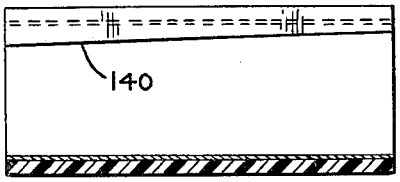
FIG. 9 is a cross-sectional view through the plane 9—9 of FIG. 8.

Referring now to FIGS. 6 and 7 there is shown a second embodiment of core structure in accordance with the present invention, which core structure is designated generally by the reference numeral 110. Core structure 110 is generally similar to core 10 and comprises a generally cylindrical element having an outer surface 120 and a core 114 extending axially throughout its major length. Formed in outer surface 120 is a channel 122 which extends generally parallel to the axis of core 114 and across the entire width of outer surface 120.

As was the case with respect to channel 22 in core 10, channel 122 of core 110 is dove-tailed in cross-sectional configuration and decreases in width across the width of core 110 from its first and 123 to its second end 125. Additionally, however, channel 122 also varies in depth from its deepest point at first end 123 to its shallowest point at second end 125. As was the case with respect to core 10 and blanket 12, a blanket 112 is provided for use with core 110, which blanket fits snugly against surface 120 of core 110 when the blanket and core are in assembled relationship. Further, a blanket for use with core 110 is provided with flange means 140, 141 which are receivable within channel 122 and which cooperate to conform to the shape of channel 122 when the blanket is assembled to core 110.

Although the embodiment of the invention showing the core channel varying both in width and in depth is shown in conjunction with a cylindrical core, it will be recognized that such a channel configuration in combination with similarly configured flange means may be utilized with basic core shapes which are other than cylindrical. Further construction of the core 110 and its cooperative blanket is achieved using the same types of materials and the same manufacturing techniques as discussed above with respect to core 10 and blanket 12.

Assembly of blanket 112 on core 110 is achieved in the same manner as assembly of blanket 12 on core 10. The narrow, think end of flanges 140, 141 are inserted into channel 122 and blanket 112 is passed over core 110 until the surfaces of flanges 140 and 141 engage the surface of channel 122 with a degree of friction. This occurs when blanket 112 is substantially fully across core 110. Thereafter a soft mallet may be used to drive blanket 112 over the remaining distance of the core so that the blanket covers core 110 and the flanges 140 and 141 are in rigid, friction tight engagement with channel 122. The resulting structure provides a roller with a rigidly secured blanket, the outer surface of which defines a surface of the shape desired, in this case a cylindrical surface.

Figure 10:
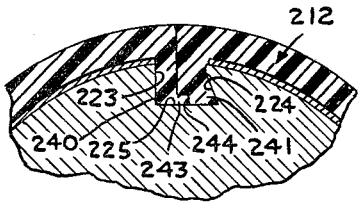
FIG. 10 is a partial cross-sectional elevational view of an alternative configuration of channel and locking element structure in accordance with the teaching of the present invention.
Figure 11:
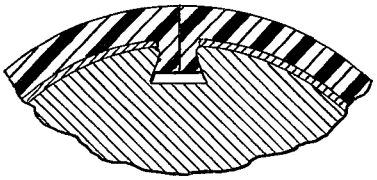
FIG. 11 is a partial elevational cross-sectional view of yet an additional alternative configuration of locking element structure in accordance with the present invention.

FIGS. 10 and 11 are cross-sectional elevational views through portions of blankets and cores to show alternative structures for securing a blanket to a core in accordance with the teaching of the present invention.

Referring therefore to FIG. 10, there is shown a portion of a core 210 having a channel 222 formed therein. Channel 222 is formed differently from either channel 22 or channel 122 as previously disclosed in that it has a generally raidally extending surface 223 and an angled surface 224 which cooperate with chordal surface 225 to define channel 222. In the same manner as was discussed above with respect to cores 10 and 110, channel 222 extends across the full width of the surface of core 210 and is adapted to accommodate the receipt therein of flanges 240 and 241 which are formed on the edges of blanket 212.

The dependent portion of flange 240 is generally rectangular in cross-section with a chordally extending lip 243 formed along the full length lower outer edge. The dependent portion of flange 241 is shaped substantially identically in cross-section to flanges 41 and 141, i.e., semi-trapezoidally, with a chordally extending channel 244 formed in the full length of its lower outer edge. Channel 244 is shaped such as to snugly receive lip 243 therein.

Either or both of flanges 240, 241 are tapered along their length to cooperate to define a tapering flange for being received within channel 222 which is correspondingly tapered. In this regard, blanket 212 is assembled onto core 210 in much the same manner as blankets 12 and 112 are so assembled as discussed above. More specifically, the narrow ends of flanges 240 and 241 are introduced through the wide end of channel 222 and blanket 212 is passed around and across core 210 until flanges 240 and 241 engage the surfaces of channel 222. Thereafter blanket 212 may be driven home into a secure friction fit forcefully through the use of a rubber mallet or the like. In this embodiment flange 240 is retained against radial removal from channel 222 by the cooperation of lip 243 with channel 244. Flange 24 is retained against radial removal from channel 222 by its cooperation with flange 240 and its engagement with angled surface 224. The blanket 212 is then ridigly retained on core 210.

FIG. 11 is a cross-sectional view showing a blanket 312 mounted on a core 310. The basic structures are identical to those shown with respect to either cores 10 and 110 and blankets 12 and 112 with the exception that flanges 340 and 341 do not extend into the full depth of channel 322.

Figure 12:
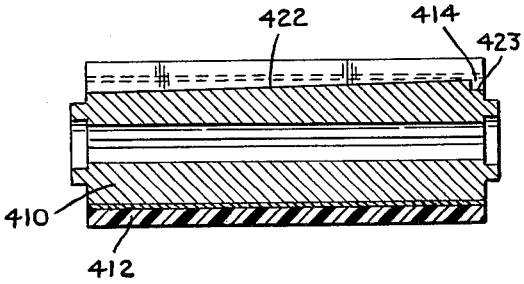
FIG. 12 is a transverse cross-sectional elevational view similar to FIG. 6 but showing a blanket utilizing a positive locking structure between the blanket and the core.

Referring to FIG. 12, there is shown a roller assembly comprising a blanket 412 mounted on a core 410. The roller assembly of FIG. 12 is substantially identicial to the structure of FIGS. 6 and 7 with the exception that there is a positive locking means between blanket 412 and core 410. More specifically, the end of channel 422 is provided with a channel 423 which extends across the chordally extending surface of the channel adjacent its narrow ends. Additionally, formed on the narrow end of the flanges of blanket 412 are depending lips 414 which are adpated to be received within channel 423. Thus, assembly of blanket 412 onto core 410 comprises insertion of the narrow end of the blanket flanges into channel 422 and advancing the blanket over the core until a frictional engagement is established between the blanket flanges and the channel 422. Thereafter the blanket is forced further over core 410 through the use of a rubber mallet or the like. Displacement of blanket 412 over core 410 is continued until lip 414 snaps into channel 423 to rigidly lock the blanket 412 in operating position on core 410.

As will be recognized by those having skill in these arts, the above disclosed roller assemblies are unique in that they each permit replacement of the roller blanket in situ and further provide for retention of the blanket on the core means without expensive and implicated locking devices.

The significant advance in the act will be immediately recognized by those skilled in these arts. Further it will be recognized that many modifications and variations to the disclosed embodiments may be made without departing from the spirit and scope of the invention.

What is claimed is:

1. Roller apparatus comprising:

a core;

means formed on said core for mounting said core with respect to a machine to be served;

a channel formed in the surface of said core and extending across the surface of said core, said channel being tapered in width from a first width adjacent a first edge to a second width adjacent a second opposite edge;

a blanket for covering said core, said blanket comprising a split element adapted to fit around the surface of said core and having first and second abutting edges; and first and second flanges depending from said first and second abutting edges, said first and second flanges, when in abutting relationship, defining a cross-sectional area substantially identical to said channel formed in said surface of said core.

2. Apparatus according to claim 1, wherein said first and second flanges, when in abutting relationship, cooperate to define a dove-tail shape.

3. Apparatus according to claim 1, wherein said channel is dove-tail in cross-sectional configuration and said first and second flanges, when in abutting relationship, cooperate to define a dove-tail shape which corresponds in cross-sectional configuration to the cross-sectional configuration of said channel.

4. Apparatus according to claim 1 wherein at least one of said first and second flanges has a lip formed on its narrow edge, said lip for cooperating with said channel to positively lock said blanket to said core when said blanket and said core are in assembled position.

5. Apparatus according to claim 1 wherein said channel decreases in depth from said first edge to said second edge.

6. Apparatus according to claim 5 wherein at least one of said first and second flanges has a lip formed on its narrow edge, said lip for cooperating with said channel to positively lock said blanket to said core when said blanket and said core are in assembled position.

7. A blanket for use in a roller assembly having a core and a replaceable cover blanket, the blanket comprising:

a cover means having a first end and a second opposed end;

a first flange dependent from said first end;

a second flange dependent from said second end;

said first flange and said first end cooperating to define a first abutting edge;

said second flange and said second end cooperating to define a second abutting edge;

said first and second flanges cooperating to define a locking element when said first and second abutting edges are in abutting engagement; and said locking element tapering in dimension from a widest dimension at one end to a narrowest dimension at its end opposite said one end.

8. A blanket according to claim 7 wherein said locking element also tapers in dimension from a deepest dimension at said one end to a shallower dimension at its end opposite said one end.

9. A blanket according to claim 7 including a lip formed in at least one of said flange means in said end opposite said core end of said locking element.

* * * * *